United States Patent [19]

Shirai

[11] Patent Number: 4,937,883

[45] Date of Patent: Jul. 3, 1990

[54] ATHLETIC SHIRT

[76] Inventor: Todd T. Shirai, 880 Leighton St., Honolulu, Hi. 96821

[21] Appl. No.: 321,871

[22] Filed: Mar. 10, 1989

[51] Int. Cl.[5] ..... A41B 1/00; A41D 27/00; A41D 31/00

[52] U.S. Cl. ..... 2/115; 2/113; 2/125; 2/243 A; 2/243 R

[58] Field of Search ..... 2/67, 113, 114, 115, 2/77, 78 R, 90, 243 R, 243 A, 243 B, 125

[56] References Cited

U.S. PATENT DOCUMENTS

| | | | |
|---|---|---|---|
| 2,035,377 | 3/1936 | Redmond | 2/125 X |
| 2,104,288 | 1/1938 | Blood | 2/115 X |
| 2,171,220 | 8/1939 | Martin | 2/90 |
| 2,434,809 | 1/1948 | Northrup | 2/90 |
| 2,456,190 | 12/1948 | Heilbronner | 2/90 |
| 2,613,360 | 10/1952 | Friedland | 2/113 X |
| 3,037,210 | 6/1962 | Neuman | 2/125 |
| 3,078,699 | 2/1963 | Huntley | 2/115 X |
| 3,137,860 | 6/1964 | Bindler | 2/115 |
| 3,945,042 | 3/1976 | Lobo | 2/2 |
| 4,421,117 | 12/1983 | Klausen et al. | 450/131 |
| 4,473,908 | 10/1984 | Knecht | 2/243 B |
| 4,494,246 | 1/1985 | Tillbrook | 2/2.1 R |
| 4,507,801 | 4/1985 | Kavanagh et al. | 2/2 |
| 4,853,976 | 8/1989 | Mertz | 2/67 |

*Primary Examiner*—Werner H. Schroeder
*Assistant Examiner*—Jeanette E. Chapman
*Attorney, Agent, or Firm*—James Creighton Wray

[57] ABSTRACT

An athletic shirt has a sleeve made of Spandex Lycra which extends in a generally cylindrical shape from a relatively small cylindrical cuff to a mid portion and then in a curvilinearly expoanding upper arm portion to a relativley large shoulder portion joined with diagonal seams to a high bulk shirt body with a front opening placket. The sleeve is tightly knitted with fine threads, is lightweight, is fast drying, is stretchable in more than one direction and is highly resilient, for lightly uniformly gripping an arm and shoulder and allowing free expansions and directional orientations of the arm without separating from the arm, while maintaining a uniform temperature and rapidly releasing perspiration in a fast drying manner. The body of the shirt is made of a high density high bulk relatively tightly knitted cotton material having stitches larger than the arm portion.

2 Claims, 1 Drawing Sheet

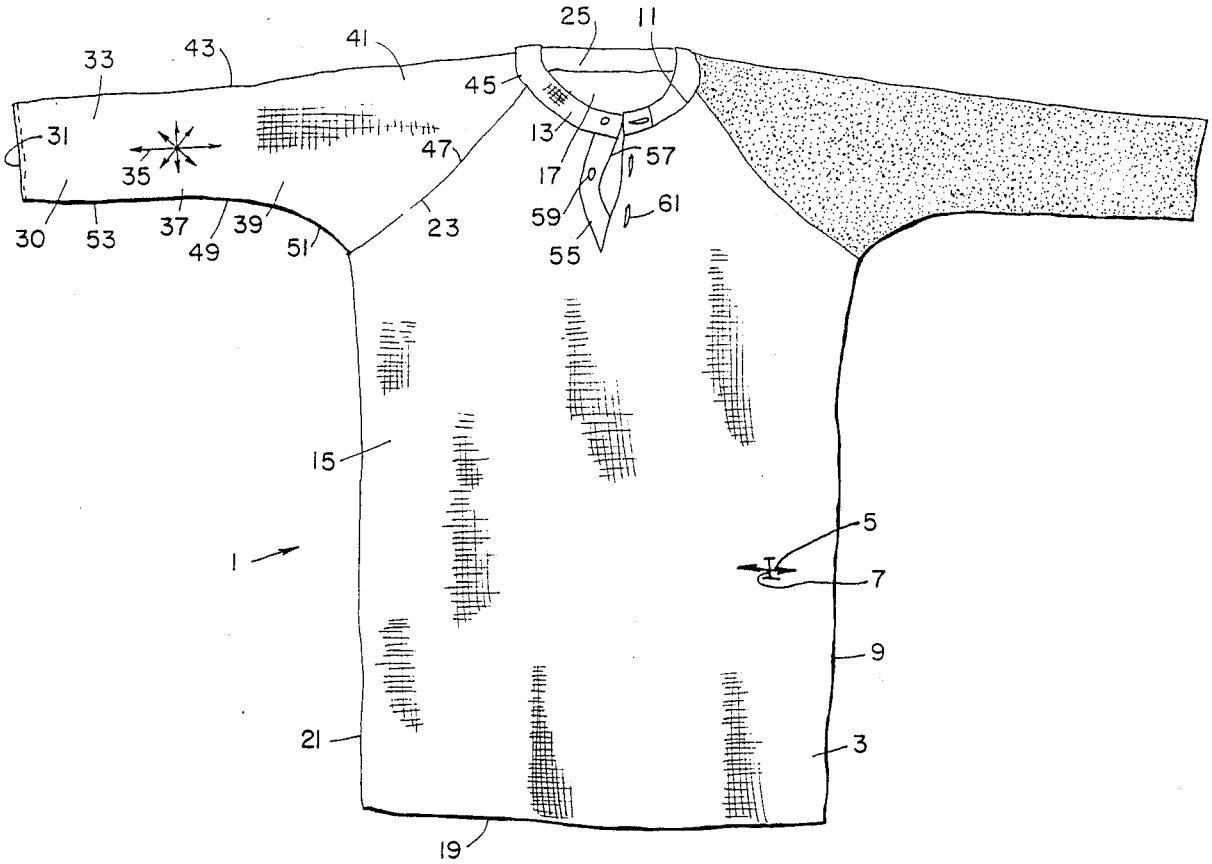
25
11
33
43
41
45
31
13
47
57
35
17
59
61
30
53
37
39
23
49
51
55
15
5
1
7
9
21
3
19

ATHLETIC SHIRT

BACKGROUND OF THE INVENTION

Baseball shirts and athletic undershirts are classically made of high bulk materials which absorb perspiration by wicking perspiration away from the body and by encouraging evaporation on the outer surfaces of the shirts. Because of propensity to change in moisture content, the fabric weight, flexibility and temperature factors also change.

The loose-fitting athletic undershirts and baseball shirts which are well known are comfortable, highly usable and wearable and perform adequately.

In spite of the long use of the shirts and the suitability of the shirts, when the shirts are actually used by baseball players the shirts provide several problems. The looseness which provides comfort also provides differential minor obstructions of movement. Changes of weight in the shirt by virtue of water absorption change weight and resistance to arm movements, which the shirt provides.

The flapping of the shirt provides minute unpredictable changes in wind resistance variations and drag on a moving arm. When the moving fingertip speed is greater than 160 feet per second such as in pitching baseballs or softballs, minor changes in the shirt weight, wind resistance or flapping or operation of the shirt may provide slight changes in accuracy or performance. The changes may be augmented by the effects of centrifugal force on the substantial sleeve material of the shirt.

Baseball and softball players have tried to overcome the basic problems by shortening the sleeve lengths. However, such shortened sleeves provide greater climatic variations to arm muscular structures, and again affect control. Players have rolled up or pushed up sleeves, but forces of throwing or pitching work against those shortening efforts.

When throwing, the arm tends to lift the shirt, but the shoulder supports the shirt. Therefore, a loose fitting shirt of the prior art tends to pull out of baseball pants and tends to bunch at the waist, above the belt.

The prior art baseball undershirts have many disadvantages which have been of long standing. Many attempts have been made to overcome those disadvantages, without success.

SUMMARY OF THE INVENTION

The present invention overcomes problems existing in the prior art by providing baseball undershirts with tightly fitting, highly stretchable arms without loss of comfort due to body restriction.

The shirt of the present invention is formed of two distinct constructions in the body and in the sleeve.

The body is a cotton-based knit interlock. Interlock is a stitch that gives higher degrees of stretch to fabrics due to various degrees of compaction. Compaction is a word used to describe the tightness of the fabric.

The reason for the shirt body construction is that, due to the various shapes and sizes of the athletes, bodies, the cotton based knit interlock material suits the athletes better for comfort because of the texture and pliability.

The sleeves are made of an arm-hugging tightly knitted or woven highly stretchable, resilient, lightweight and fast drying material such as SPANDEX-LYCRA, which is a textile fiber with remarkable stretch and recovery properties. It is capable of a 500% stretch with a full recovery rate. Spandex Lycra is also considerably stronger and more durable than conventional elastic thread, weighs a third less, wears longer, and provides two to three times more restraining power.

The sleeve construction uses Spandex Lycra's stretch and recovery properties, strength, durability, weight and its variety of colors, and it functions as a better fabric in the production of sleeves for an athletic undershirt. Functions are detailed below as follows.

The shirt of the present invention provides added warmth through insulation. For a baseball player, keeping an arm warm is a must for preventative maintenance against injury of that limb. By insulating the arm with flexible freedom, and at the same time keeping a degree of restraining power, the shirt enables athletes to keep their arms warm, without disrupting the constant flow of blood which is needed. Because of its fit, Spandex Lycra gives the present sleeves a thermal therapeutic dimension that other undershirts cannot give. Insulating the arm negates heat loss by the movement of warm air away from the arm via spontaneous air flow through openings in the conventional sleeve and by air movement in gaps between the arm and the conventional sleeves, that is termed heat loss by convection.

The present shirt provides positive factors of arm speed. By keeping the necessary warmth in an arm, one is more likely to reach full capability with respect to arm strength. The present sleeves, which are lighter due to the weight of the fabric, also have the added benefit of having less drag on the arm because of form fitting sleekness. Therefore, the present sleeves aerodynamically are more beneficial than the conventional sleeves. The types of fabrics used for the present sleeves are comparable to the type used in swimwear, which holds its shape and has quick-drying capabilities. The same tight fitting, quick-drying values are provided in the present sleeves for the benefit of keeping the weight of the sleeves light by not retaining the perspiration. The conventional cotton and wool undershirts cannot provide those advantages because of the tendency of those fabrics to retain fluids, thus getting heavier and unmanageable.

The interlock stretch fabric of the body provides comfort through texture and pliability. The shirt body provides a wearer's trunk with a regular fit, which does not provide unusual feelings of tightness or temperature which might otherwise be objectionable if the body were made of the same material as the shirt.

SPANDEX-LYCRA's practical usage gives the player the positive gains he needs without restricting the arm motion, adding bulk, or retaining extra weight through perspiration. This affords the player every benefit needed in an undershirt without feeling like he is wearing one on his arm.

The loose body of the shirt does not take away from neat uniform appearance, while the tight sleeves give the player an overall sharper image.

The sleeve is produced as a full length with an added benefit. The benefit is being able to adjust the sleeve to three-quarter length upon one's own preference. Unlike other shirts, the present sleeve holds snugly onto an arm without having to adjust and tug at the sleeve every time a conventional sleeve falls back to its lengthened position.

An athletic shirt has a sleeve made of Spandex Lycra which extends in a generally cylindrical shape from a relatively small cylindrical cuff to a mid portion and then in a curvilinearly expanding upper arm portion to a relatively large shoulder portion. The shoulder portion as joined with diagonal seams to a high bulk body portion with a front opening placket. The sleeve is tightly woven and lightweight and is fast drying and is stretchable in more than one direction and is highly resilient. The sleeve lightly and uniformly grip an arm and shoulder and allows free expansions and directional orientations of the arm without the sleeve separating from the arm. The uniquely constructed shirt maintains a uniform temperature and rapidly releases perspiration in a fast drying manner. The body of the shirt is made of a high density high bulk relatively tightly knitted cotton material having stitches larger than the arm portion.

A preferred baseball shirt has a knitted body made of cotton or cotton-blend material and has arms made of a four-way stretch SPANDEX-LYCRA type material. The arms are permanently joined to the body of the shirt. The body of the shirt is constructed of a relatively high weight, high bulk material with relatively large threads and relatively large stitches in tight compaction. The body of the shirt is stretchable in one direction and is relatively nonresilient. The sleeves of the shirt are constructed of relatively lightweight light bulk material having relatively small stitches. The sleeves are stretchable in all directions and are resilient and highly elastic for quickly returning to shape. The body of the shirt is highly absorbable. The sleeves arc quick-drying.

The preferred athletic shirt of the present invention has a rear body panel with a generally rectangular form. An upper edge of the rear body panel is curved. Upper lateral edges of the body panel slope downward from the curved edge to side edges, thereby forming sleeve joining edges along the slope. The front panel has a generally rectangular shape with a bottom edge and side edges extending upward from the bottom edge and has a curved top edge. Sloped upper edges extend from the curved top edge to the side edges. A vertical slit extends downward from the curved top edge. Fastener means connected along the slit selectively fasten and unfasten the slit. The shirt has first and second sleeves. Each sleeve has a generally tubular shape and expands from a generally cylindrical shape near a cuff portion to a large funnel shape at a body joining portion. The body joining portion has front and back long sloped edges joined to upper sloped edges of the body. The body is made of a knitted cotton material, and the sleeves are made of a thin, lightweight, fast drying, multi-way stretch, highly resilient material.

In the preferred athletic shirt, the sleeves when flattened form a generally five-sided figure. A relatively long, straight upper edge terminates in a short curved inner edge. A straight, sloped body-joining edge joins a curved and straight inner arm edge, which terminates in a cuff edge at one end of the long straight edge. Preferably, the sleeves are raglan sleeves for encompassing both arms and shoulders of a user.

A preferred baseball shirt has a SPANDEX-LYCRA arm extending cylindrically from a relatively small cylindrical cuff along a lower arm area and expanding outward in a curvilinear relation from the generally cylindrical portion along an upper arm area. The sleeve terminates inwards in a relatively large shoulder covering area. Generally linear seams join the shoulder covering area with front and back knitted cotton fabric panels of the shirt. The sleeve is lightweight, is stretchable in more than one direction and is fast drying. The body is stretchable in one direction and has a relatively high bulk.

These and other and further objects and features of the invention are apparent in the disclosure, which includes the above and ongoing specification, with the claims, and the drawings.

BRIEF DESCRIPTION OF THE DRAWINGS

The drawing shows a shirt of the present invention having Spandex Lycra sleeves and a knitted cotton body.

DETAILED DESCRIPTION OF THE DRAWING

A shirt of the invention is generally indicated by the numeral 1. The shirt has a body 3 made of cotton-based knit interlock material. The knit interlock stitch gives a high degree of stretch to the fabric in the direction shown by arrows 5. Cotton knit interlock material has little stretch in the vertical direction shown by the line 7.

The cotton material has a low resilience and when stretched will retain its stretched position, with slow but not full recovery to its original position. With reasonable force, the stretch shown in the direction of arrow 5 might be about 50 percent. The shirt fabric will tend to remain stretched but will recover slowly.

The shirt body has side seams 9. An upper edge 11 of the shirt body is curved. A collar 13 made of similar material is sewn to the upper edge 11 of the shirt body.

The collar has a radial stitch alignment as opposed to the vertical stitch alignment on the shirt body.

The shirt body 3 has similar front and rear panels 15 and 17. Each has a bottom edge 19 and side edges 21. Each has upper lateral sloping edges 23, which on the front panel extend from curved edge 11 to side edges 21, and which on the rear panel extend from curved edge 25 to side edges 21.

The sleeves are generally indicated by the numeral 30. In a preferred embodiment such as shown in the drawing, both sleeves are formed of the same construction and material. Both sleeves stretch in any direction as indicated by the arrows in cluster 35, and both sleeves are resilient as indicated by the inward pointing arrows in the cluster. The sleeves are generally tubular in shape and extend inward from a cuff 31 in a cylindrical portion 33 to an elbow area 37 of the shirt, and then expand in a funnel-shaped portion 39 to the shoulder-covering portion 41. The sleeves are characterized by a generally straight upper edge 43, a short curved inner edge 45, a downward sloping seamed edge 47, and a lower edge 49 having a curved portion 51 and a generally straight portion 53.

The front of the shirt may be closed in any way, however, a placket 55 is preferred. The front of the shirt is slit 57 and complementary fasteners 59 and 61, in this case being buttons and buttonholes, are used to close the slit 57.

In a preferred embodiment, free edges of the material such as bottom edges 19 are rolled and overcast stitched, and edges of seamed materials are joined and overcast stitched and then stitched along seam lines.

The seams between sloping lines 23 and 47 are formed from abutting edges of the material and then overcasting the edges with lock stitches, and then stitching the seam lines. The seam along cuff 31 and the seam along the curved bottom 49 of the sleeve are formed in similar manners, using highly elastic threads and stitches which do not prevent the stretching of the sleeve material.

The cylindrical portion 33 of the tubular sleeves 30 permits sliding cuff 31 along a forearm to create a three-quarter inch sleeve, which holds itself in the desired position because of the resilience of the material.

The shirt of the present invention has the unique effect of tightly hugging the shoulders, upper arms and lower arms of a user, with a constant nondiscernible force, while draping on the body of the user with the feeling of a conventional athletic undershirt. The unique result is that the muscles of the shoulder and the upper arm and the lower arm are gently held by a continuous nondiscernible inward force, maintaining the muscles lightly inwardly held and directly overlying the muscles with a sleek, quick-drying material.

The thin, lightweight, resilient material in the present invention overlies the trapezius deltoideus, biceps brachii and triceps brachii, as well as all muscles of the lower arm and ligaments, veins and arteries of the arms, with a gentle squeezing, which is beneficial to the arm while undergoing rapid directional changes and when resting in between changes. The unique arm covering material provides no resistance to arm movement in any direction and permits movement of the arm without restriction and while maintaining its gentle, firm inward forces. Because the arm covering and shoulder covering material readily stretches with flexing and extending motions, the sleeve and shoulder portions stretch, leaving the body portion generally draped flat on the body. Upward movement of the shoulder portion simply stretches the shoulder portion outward without stretching the back of the shirt or pulling the shirt out of its tucked-in position. Consequently, the shirt always feels comfortable and looks neat.

Many of the problems associated with shirts of the prior art are solved in unique ways by the unique construction and differentiated materials in the body and sleeve portion of the present invention.

While the invention has been described with reference to a specific embodiment, modifications and variations of the invention may be constructed without departing from the scope of the invention.

I claim:

1. A baseball shirt having a knitted body made of cotton or cotton-blend material and having sleeves made of four-way stretch SPANDEX-LYCRA type material, the sleeves being permanently joined to the body of the shirt, the body of the shirt comprising a relatively high bulk material with relatively large threads and no less than 12 stitches per inch, the body of the shirt being stretchable in one direction, and the sleeves of the shirt being constructed of relatively lightweight, low bulk material having relatively small stitches and being stretchable in all directions and being resilient and highly plastic for quickly returning to shape, the body of the shirt being highly absorbable; the sleeves being quick-drying.

2. A baseball shirt having a SPANDEX-LYCRA sleeve extending cylindrically from a relatively small cylindrical cuff along a lower arm area and expanding outward in a curvilinear relation from the generally cylindrical portion along an upper arm area and terminating inwardly in a relatively large shoulder-covering area and in a line joining the shoulder-covering area to a seam joining the shoulder-covering area with front and back knitted cotton fabric panels of the shirt, the sleeves being lightweight and stretchable in more than one direction and fast drying, and a body of the shirt being stretchable in one direction and having a relatively high bulk material.

* * * * *